United States Patent [19]

Crow

[11] Patent Number: 5,011,039

[45] Date of Patent: Apr. 30, 1991

[54] DEVICE TO SUPPORT AND PROTECT DOCUMENTS

[76] Inventor: Tommi L. Crow, 804 Ramblewood, Lewisville, Tex. 75067

[21] Appl. No.: 320,995

[22] Filed: Mar. 9, 1989

[51] Int. Cl.[5] ..... B61D 21/00

[52] U.S. Cl. ..... 220/357; 206/443

[58] Field of Search ..... 220/355, 357, 18, 356; 206/443

[56] References Cited

U.S. PATENT DOCUMENTS

| | | | |
|---|---|---|---|
| 3,561,982 | 2/1971 | Oeth | 220/355 |
| 3,943,987 | 3/1976 | Rossi | 220/355 |
| 4,254,891 | 3/1981 | Jeppsson | 220/355 |

FOREIGN PATENT DOCUMENTS

| | | | |
|---|---|---|---|
| 511226 | 8/1939 | United Kingdom | 220/357 |

*Primary Examiner*—Joseph Man-Fu Moy

*Attorney, Agent, or Firm*—Harry C. Post, III

[57] ABSTRACT

A device to support and protect documents, which may be damaged when contacted with water, uses a tubular body constructed of a material sufficiently transparent to allow visual observation when the documents are disposed within a chamber in the body. The body has first and second ends and a wall extending between the first and second ends so as to circumscribe the chamber. Attaching apparatus is connected to the tubular body for attaching the tubular body to a support member. A first stopper is connected to the body for preventing moisture from gaining access through the first end into the chamber in the body. A second stopper is selectively connected to the body for preventing moisture from gaining access through the second end into the chamber in the body when connected to the body and for permitting access to the chamber in the body when inserting the documents into the body when the second stopper is disconnected from the body. The second stopper has a blocking wall and at least one side wall connected to and extending away from the blocking wall. The side wall is sufficiently flexible to engage and slide over an exterior surface of the body. The wall of the body is made from a material and has a tickness chosen to provide sufficient resiliency so that the wall will not tear when the second stopper is connected to the body.

20 Claims, 1 Drawing Sheet

DEVICE TO SUPPORT AND PROTECT DOCUMENTS

Figure 1:
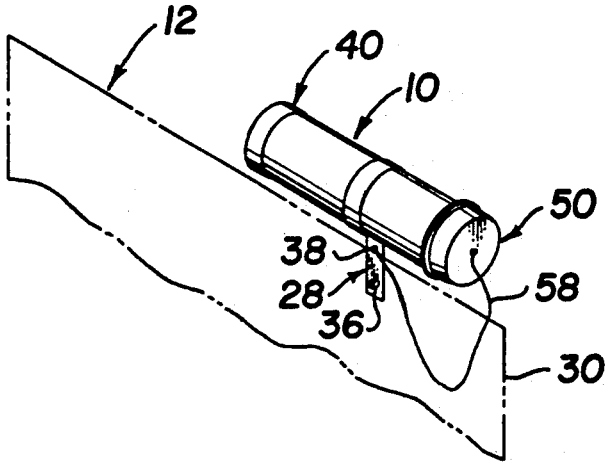

When selling non-commercial real estate, such as a house and yard, it is common practice to place a sign announcing such sale and identifying the real estate agent having the listing in the yard. To allow documents containing information about the property to be obtained by an interested potential purchaser without the necessity of such potential purchaser going to the real estate agent's office, a device was developed that supports such documents. This prior art device includes a tubular body constructed of a material sufficiently transparent to allow visual observation of the documents when disposed within a chamber in the body. The body has first and second ends and a wall extending between the first and second ends and circumscribing the chamber. The wall has an interior surface facing a chamber of sufficient size to support documents having a size of 8½×11 inches and an exterior surface facing outwardly of the chamber. An attaching strap is connected to the body for attaching the body to a support member, which may be a sign advertising real estate for sale. The attaching strap is a metal strap having a width sufficiently small to permit viewing the documents around the strap and through the body and being elongated with a length sufficient to encircle said body, to be connected to itself and to be clamped on each side of the support member. A bolt extends through the metal strap and a nut is threadedly connected to the bolt to urge the ends of the strap into engagement with and attachment to the support member when turned relative to the bolt. A first stopper has a plugging wall and a side wall in the shape of a circular tube having one end connected to the plugging wall and the other end open. The open end of the side wall of the first stopper has an inside diameter sufficient to fit over an outside diameter of the wall at the first end of the body and is supported thereon. A second stopper is selectively connected to the body to permit access to the chamber in the body when inserting the documents into the body when the second stopper is disconnected from the body. The second stopper has a plugging wall that forms a shoulder to butt against the end of the wall forming the body and a side wall in the shape of a circular tube haivng one end connected to the plugging wall and the other end open. The open end of the side wall of the second stopper has an outside diameter sufficient to fit within an inside diameter of the wall at the second end of the body and is supported therein. A nylon string retains the second stopper with the body to prevent loss of the second stopper when the second stopper is disconnected from the body and has a sufficient length to allow the second stopper to move past the second end of the body and become connected to the body.

Although the prior art device works well in sunny weather, when there is a rain storm, the prior art device will allow water to pass into the chamber in the body thereby allowing any documents disposed in the chamber to become wet. Should the documents become wet, a prospective purchaser will not take one of the documents and the prior art device will not work. Further, the wet documents are thrown away and replaced or reprinted, which is wasteful. This problem is made worse after the prior art device has been used for a period of time because the wall of the body cracks and splits along its length. It is believed that these cracks and splits are caused by the thin wall thickness and choice of material used in making the body. Further, the design of the second stopper is contributing to this problem in that when inserting the second stopper into the body, the body wall is urged towards its exterior so as to generate shear stresses therein.

Accordingly, it is an object of the present invention to provide a device to support and protect documents, which may be damaged when contacted with water.

In accordance with the invention, there is provided a device to support and protect documents, which may be damaged when contacted with water. A tubular body is used in the device and is constructed of a material sufficiently transparent to allow visual observation of the documents when disposed within a chamber in the body. The body has first and second ends and a wall extending between the first and second ends and circumscribing the chamber. Attaching apparatus is connected to the body for attaching the body to a support member. A first stopper is connected to the body for preventing moisture from gaining access through the first end into the chamber in the body. A second stopper is selectively connected to the body for preventing moisture from gaining access through the second end into the chamber in the body when connected to the body and for permitting access to the chamber in the body when inserting the documents into the body when the second stopper is disconnected from the body. The second stopper has a blocking wall and at least one side wall connected to and extending away from the blocking wall. The side wall is sufficiently flexible to engage and slide over an exterior surface of the wall of the body. The wall of the body is made from a material and has a thickness chosen to provide sufficient resiliency so that the wall will not tear when the second stopper is connected to the body.

Figure 2:
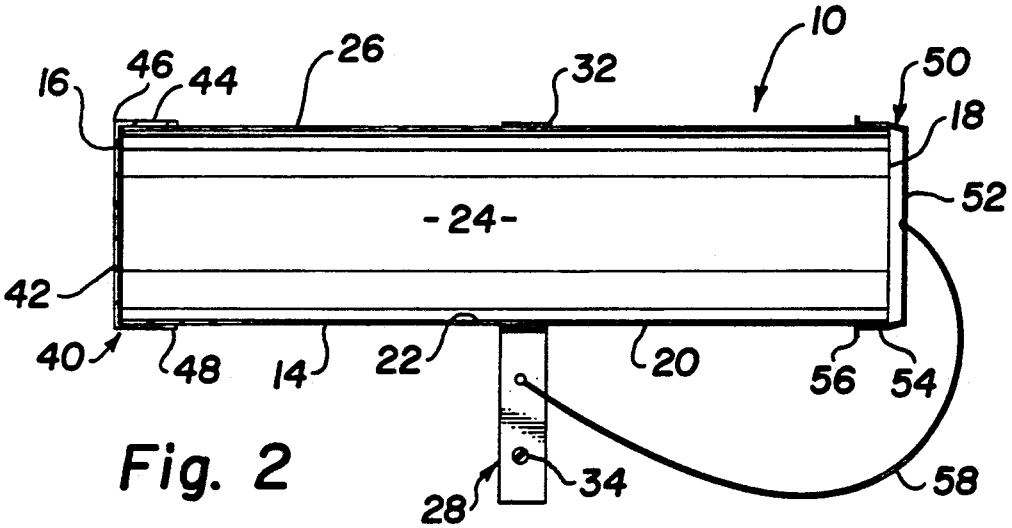
Figure 3:
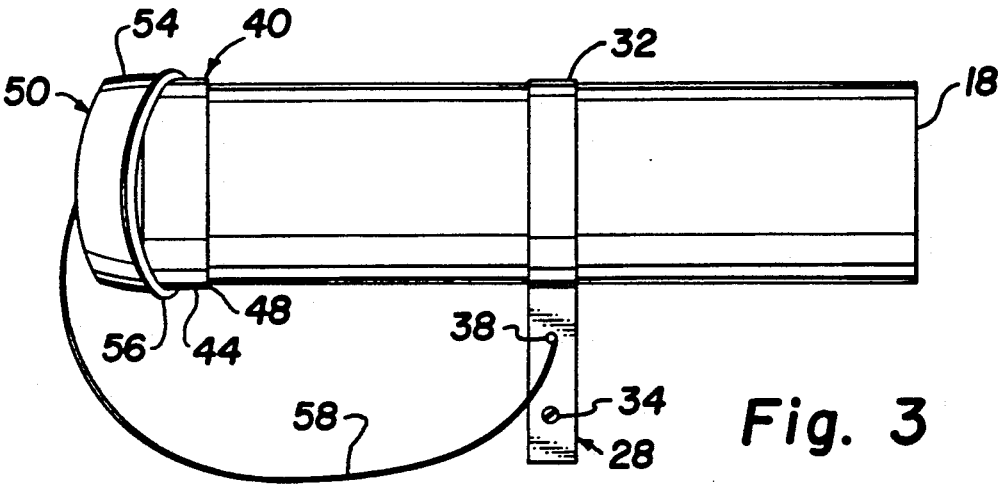

Other objects and advantages of the invention will become apparent upon reading the following detailed description and upon reference to the drawings, wherein like reference characters are used throughout to designate like parts:

FIG. 1 a perspective view of a device to support information documents constructed in accordance with the present invention attached to a sign;

FIG. 2 is a cross-sectional, side elevational view of the invention shown in FIG. 1; and FIG. 3 is a side elevational view of the invention shown in FIG. 1, with the device opened to receive information documents.

Turning to the drawing, there is shown in FIGS. 1–3 a device 10 to support and protect documents, which may become damaged when contacted with water, constructed according to the present invention attached to a support member 12, such as an advertising sign used in advertising real estate for sale.

A tubular body 14 is used in device 10 and is constructed of a material sufficiently transparent to allow visual observation of the documents when disposed within body 14. The material of body 14 is, preferably, chosen from a thermoclear tenite butyrate polymer. Body 14 has a first end 16, a second end 18 and a wall 20 disposed in the shape of a circular tube and extending between first and second ends 16 and 18, respectively. Wall 20 has an interior surface 22 facing a chamber 24 of sufficient size to support documents having a size of 8½×11 inches and an exterior surface 26 facing outwardly of chamber 24. It has been found that a tubular body made of thermoclear tenite butyrate polymer and having a length of 12 inches, an inside diameter of 2 and 29/32 inches, an outside diameter of 3 inches and a wall thickness of 3/64 inch (the wall thickness being the distance between exterior surface 26 and interior surface 22) has worked well in accordance with the present invention.

An attaching device 28 is connected to body 14 for attaching body 14 to a support member 30, which is preferably a sign advertising real estate for sale. Attaching device 28 includes a metal strap 32 having a width sufficiently small to permit viewing of the documents around the strap and through body 14. Metal strap 32 is elongated with a length sufficient to encircle body 14, to be connected to itself and to be clamped on each side of support member 30. Also, included in attaching device 28 are a threaded member 34 extending through metal strap 32 and a wing nut 36 threadedly connected to threaded member 34 for urging the ends of strap 32 into engagement with and attachment to support member 30 when turned relative to threaded member 34, and a rivet 38 for securing strap 32 to body 14. To assist in preventing tubular body 14 from becoming unbalanced and have one or the other end 16 or 18 move closer to support member 30, metal strap 32 is disposed substantially equidistant of first and second ends 16 and 18, respectively, of body 14. It has been found that, when tubular body 14 has an outside diameter of 3 inches, a metal strap 32 made from aluminum, having a length of 14 inches, a thickness of 0.040 inches, a width of ¾ inch, and with a first set of holes for receiving threaded member 34 are provided at ¾ inch from each end of the strap and a second set of holes for receiving rivet 38 are provided at 2 and ¼ inches from each end of strap 32 has worked well in accordance with the present invention.

A first stopper 40 is connected to body 14 for preventing moisture from gaining access through first end 16 into chamber 24. First stopper 40 has a plugging wall 42 and a side wall 44 in the shape of a circular tube having one end 46 connected to plugging wall 42 and the other end 48 open. Open end 48 of side wall 44 of first stopper 40 has an inside diameter (the distance between facing surfaces of side wall 44) sufficient to fit over exterior surface 26 of wall 20 at first end 16 of body 14 and is connected thereto. It has been found that, when tubular body 14 has an outside diameter of 3 inches, a first stopper 40 made from polyethlene material and having an inside diameter of approximately 2 and 15/16 inches and an inside length of 1 inch (the inside length being the length of side wall 44) has worked well in accordance with the present invention.

A second stopper 50 is adapted to be selectively connected to body 14 for preventing moisture from gaining access through second end 18 into chamber 24 when connected to body 14 and for permitting access to chamber 24 in body 14 when inserting the documents into body 14 when second stopper 50 is disconnected from body 14. Second stopper 50 is made in the shape of a truncated cone having a blocking wall 52 forming the truncated portion of the cone and at least one side wall 54 connected to the blocking wall and disposed to form the conical portion of the cone. Side wall 54 is sufficiently flexible to engage and slide over exterior surface 26 of body 14 and to be disposed over and supported on first stopper 40 when second stopper 50 is disconnected from second end 18 of body 14, as best seen in FIG. 3. If desired, a shoulder 56 may be connected to side wall 54 away from the connection with blocking wall 52 to assist a user of device 10 in attaching or removing second stopper 50 to second end 18 or in attaching or removing second stopper 50 to first stopper 40. It has been found that, when tubular body 14 has an outside diameter of 3 inches, a second stopper 50 made from polyethlene material and having a lateral inside length (the distance between blocking wall 52 and shoulder 56) of approximately 1 inch, an inside diameter of 3.041 inches at shoulder 56 and an inside diameter of 2.915 at blocking wall 52 has worked well in accordance with the present invention.

A flexible, inelastic retainer 58 may be used in device 10 for retaining second stopper 50 with body 14 to prevent loss of second stopper 50 when second stopper 50 is disconnected from body 14. Retainer 58 has one end connected to attaching device 28 at rivet 38 and another end connected to second stopper 50 at the center of blocking wall 52. Preferably, flexible retainer 58 is a nylon string of sufficient length to allow second stopper 50 to move past second end 18 of body 14 and become connected to body 14. It has been found that, when tubular body 14 has a length of 12 inches, a retainer 48 having a length of 12 inches has worked well in accordance with the present invention.

In operation, a real estate agent would take a device 10 along when inspecting a new listing. After the sign advertising the real estate for sale is driven into the ground, wing nut 36 is rotated relative to threaded member 34 by an amount sufficient to allow the ends of strap 32 to be separated and placed on each side of sign 30. Device 10 is then fastened to sign 30 by rotating wing nut 36 relative to threaded member 34 by an amount sufficient to tighten the ends of strap 32 into engage with each side of sign 30. Second stopper 50 is removed from tubular body 14 and attached to first end 40 or allowed to be supported by retainer 58. Advertising documents, such as a floor plan, when the property will be built, and other specifications, is disposed in chamber 24 in body 14. Second stopper 50 is then positioned with shoulder 56 facing second end 18 and moved into engagement with body 14, the flexibility of side wall 54 of second stopper being used to secure second stopper 50 to body 14. From time to time, the real estate agent may drive past the property to inspect it and at the same time the agent can inspect device 10 to determine whether anybody has taken the advertising documents. If no documents are present in body 14, the agent can take a fresh supply of the correct advertising documents to device 10 and place them inside.

The invention having been described, what is claimed is:

1. A device to support and protect documents, which may be damaged when contacted with water, comprising: a tubular body being constructed of a material sufficiently transparent to allow visual observation of the documents when disposed within a chamber in said body, said body having first and second ends and a wall extending between the first and second ends and circumscribing the chamber; attaching means connected to said body for attaching said body to a support member; first stopper means connected to said body for preventing moisture from gaining access through the first end into the chamber in said body; and second stopper means selectively connected to said body for preventing moisture from gaining access through the second end into the chamber in said body when connected to said body and for permitting access to the chamber in said body when inserting the documents into said body when said second stopper means is disconnected from said body, said second stopper means having a blocking wall and at least one side wall connected to and extending away from said blocking wall, the side wall being sufficiently flexible to engage and slide over an exterior surface of the wall of said body, the wall of said body being made from a material and having a thickness chosen to provide sufficient resiliency so that the wall will not tear when said second stopper means is connected to said body.

2. A supporting and protecting device as set forth in claim 1, further comprising: flexible, inelastic retaining means for retaining said second stopper means with said body to prevent loss of said second stopper means when said second stopper means is disconnected from said body.

3. A supporting and protecting device as set forth in claim 2, further comprising: said flexible connecting means including a nylon string of sufficient length to allow said second stopper means to move past the second end of said body and become connected to said body.

4. A supporting and protecting device as set forth in claim 1, further comprising: the second end of said body being displaced away from the first end by a distance sufficient to support documents having a size of $8\frac{1}{2}\times 11$ inches within the chamber.

5. A supporting and protecting device as set forth in claim 1, further comprising: the material of said body being chosen to be a thermoclear tenite butyrate polymer.

6. A supporting and protecting device as set forth in claim 5, further comprising: said first and second stopper means being chosen to be made from a polyethlene.

7. A supporting and protecting device as set forth in claim 1, further comprising: said attaching means being connected to said body substantially equidistant between the first and second ends of said body and elongated with a length sufficient to encircle said body, to be connected to itself and to be urged against each side of the support member.

8. A supporting and protecting device as set forth in claim 7, further comprising: said attaching means including a metal strap having a width sufficiently small to permit viewing of the documents around the metal strap and through said body.

9. A supporting and protecting device as set forth in claim 8, further comprising: said attaching means including a threaded member extending through the metal strap and a wing nut threadedly connected to the threaded member for urging the ends of the strap into engagement with and attachment to the support member when rotated relative to the threaded member.

10. A device to support and protect documents, which may be damaged when contacted with water, comprising: a tubular body being constructed of a material sufficiently transparent to allow visual observation of the documents when disposed within said body, the material of said body being chosen from a thermoclear tenite butyrate polymer, said body having first and second ends and a wall disposed in the shape of a circular tube and extending between the first and second ends, the wall having an interior surface facing a chamber of sufficient size to support documents having a size of $8\frac{1}{2}\times 11$ inches and an exterior surface facing outwardly of the chamber; attaching means connected to said body for attaching said body to a support member, said attaching means including a metal strap having a width sufficiently small to permit viewing of the documents around the strap and through said body, the metal strap being elongated with a length sufficient to encircle said body, to be connected to itself and to be clamped on each side of the support member, the metal strap being disposed substantially equidistant of the first and second ends of said body, and a threaded member extending through the metal strap, and a wing nut threadedly connected to the threaded member for urging the ends of the strap into engagement with and attachment to the support member when turned relative to the threaded member; first stopper means connected to said body for preventing moisture from gaining access through the first end into the chamber of said body, said first stopper means having a plugging wall and a side wall in the shape of a circular tube having one end connected to the plugging wall and the other end open, the open end of the side wall of said first stopper means having an inside diameter sufficient to fit over an outside diameter of the wall at the first end of said body and connected thereto; second stopper means adapted to be selectively connected to said body for preventing moisture from gaining access through the second end into the chamber in said body when connected to said body and for permitting access to the chamber in said body when inserting the documents into said body when said second stopper means is disconnected from said body, said second stopper means being in the shape of a truncated cone having a blocking wall forming the truncated portion of the cone and at least one side wall connected to the blocking wall and disposed to form the conical portion of the cone, the side wall being sufficiently flexible to engage and slide over the exterior surface of said body and to be disposed over and supported on said first stopper means when said second stopper means is disconnected from the second end of said body, said first and second stopper means made from a material chosen from polyethlene; the wall of said body being made from a material and having a thickness chosen to provide sufficient resiliency so that the wall will not tear when said second stopper means is connected to said body; and flexible, inelastic retaining means for retaining said second stopper means with said body to prevent loss of said second stopper means when said second stopper means is disconnected from said body, said flexible connecting means including a nylon string of sufficient length to allow said second stopper means to move past the second end of said body and become connected to said body.

11. A device to support and protect documents, which may be damaged when contacted with water, comprising: a tubular body being constructed of a material sufficiently transparent to allow visual observation of the documents when disposed within a chamber in said body, said body having first and second ends and a wall extending between the first and second ends and circumscribing the chamber, the wall of said body being disposed in the shape of a circular tube; attaching means connected to said body for attaching said body to a support member; first stopper means connected to said body for preventing moisture from gaining access through the first end into the chamber in said body; and second stopper means selectively connected to said body for preventing moisture from gaining access through the second end into the chamber in said body when connected to said body and for permitting access to the chamber in said body when inserting the documents into said body when said second stopper means is disconnected from said body, said second stopper means being in the shape of a truncated cone and having a blocking wall forming the truncated portion of the cone and at least one side wall connected to and extending away from said blocking wall, the side wall forming the sides of the cone and being sufficiently flexible to engage and slide over an exterior surface of the wall of said body, the wall of said body being made from a material and having a thickness chosen to provide sufficient resiliency so that the wall will not tear when said second stopper means is connected to said body.

12. A supporting and protecting device as set forth in claim 11, further comprising: said first stopper means having a plugging wall and a side wall in the shape of a circular tube having one end connected to the plugging wall and the other end open, the open end of the side wall of said first stopper means having an inside diameter sufficient to fit over an outside diameter of the wall at the first end of said body and connected thereto; and said second stopper means being sufficiently flexible to be disposed over and supported on said first stopper means when said second stopper means is disconnected from the second end of said body.

13. A supporting and protecting device as set forth in claim 11, further comprising: flexible, inelastic retaining means for retaining said second stopper means with said body to prevent loss of said second stopper means when said second stopper means is disconnected from said body.

14. A supporting and protecting device as set forth in claim 13, further comprising: said flexible connecting means including a nylon string of sufficient length to allow said second stopper means to move past the second end of said body and become connected to said body.

15. A supporting and protecting device as set forth in claim 1, further comprising: the second end of said body being displaced away from the first end by a distance sufficient to support documents having a size of $8\frac{1}{2} \times 11$ inches within the chamber.

16. A supporting and protecting device as set forth in claim 1, further comprising: the material of said body being chosen to be a thermoclear tenite butyrate polymer.

17. A supporting and protecting device as set forth in claim 16, further comprising: said first and second stopper means being chosen to be made from a polyethlene.

18. A supporting and protecting device as set forth in claim 1, further comprising: said attaching means being connected to said body substantially equidistant between the first and second ends of said body and elongated with a length sufficient to encircle said body, to be connected to itself and to be urged against each side of the support member.

19. A supporting and protecting device as set forth in claim 18, further comprising: said attaching means including a metal strap having a width sufficiently small to permit viewing of the documents around the metal strap and through said body.

20. A supporting and protecting device as set forth in claim 19, further comprising: said attaching means including a threaded member extending through the metal strap and a wing nut threadedly connected to the threaded member for urging the ends of the strap into engagement with and attachment to the support member when rotated relative to the threaded member.

* * * * *